United States Patent [19]

Horton

[11] 4,148,953

[45] Apr. 10, 1979

[54] AIR PERVIOUS WEATHERSTRIP

[75] Inventor: Robert C. Horton, Rochester, N.Y.

[73] Assignee: Ultrafab, Inc., Victor, N.Y.

[21] Appl. No.: 874,288

[22] Filed: Feb. 1, 1978

[51] Int. Cl.[2] ..... D04H 11/00; E06B 7/22

[52] U.S. Cl. ..... 428/85; 49/475; 49/489; 428/92; 428/93

[58] Field of Search ..... 428/85, 92, 93; 49/475, 49/489

[56] References Cited

U.S. PATENT DOCUMENTS

| | | | |
|---|---|---|---|
| 3,175,256 | 3/1965 | Horton | 49/489 |
| 3,745,053 | 7/1973 | Johnson | 428/85 |
| 3,836,421 | 9/1974 | Terry | 49/475 |

*Primary Examiner*—Marion E. McCamish
*Attorney, Agent, or Firm*—Martin LuKacher

[57] ABSTRACT

A weatherstrip has a backing strip on which is attached two longitudinal rows of pile. An air infiltration membrane is secured near one end to the backing strip and is supported in upright position between the two rows of pile. When the weatherstrip is disposed in sealing engagement with a closure member, such as a window or door, it provides controlled air infiltration therethrough without increased stiffness which would make movement of the closure member, as in opening or closing the window or door, difficult.

11 Claims, 5 Drawing Figures

FIG. 1
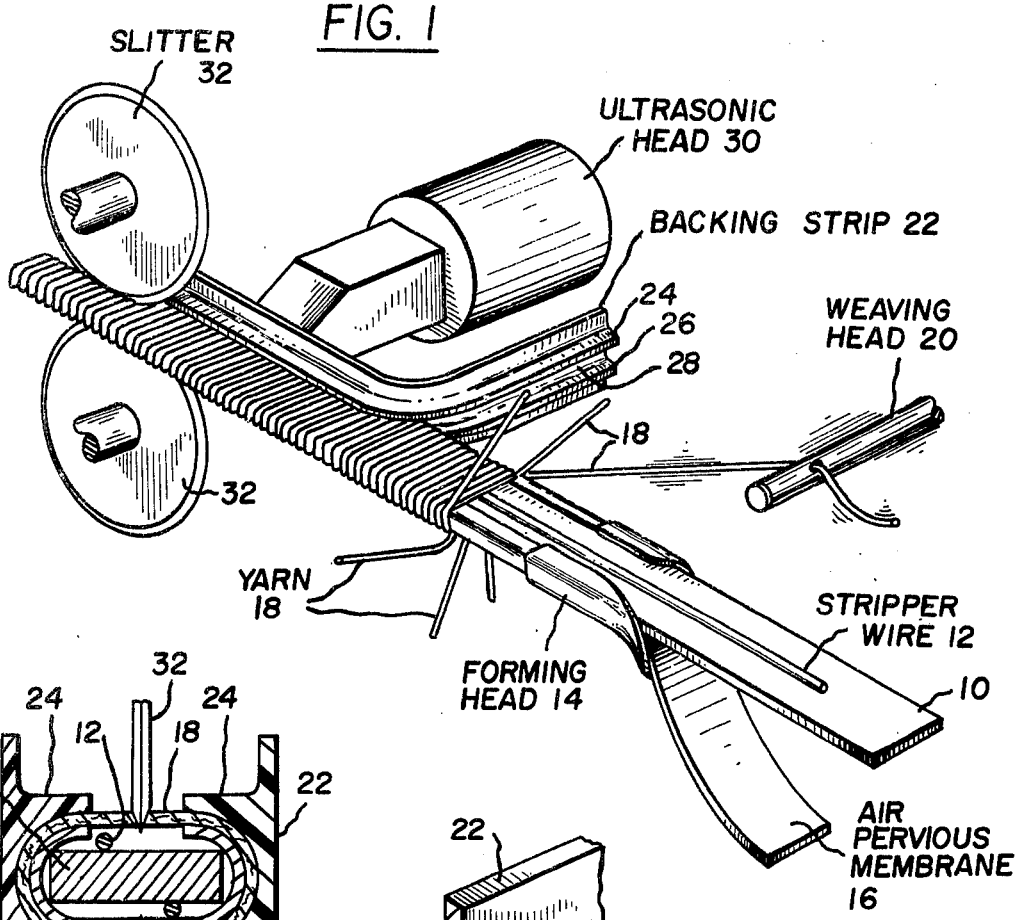
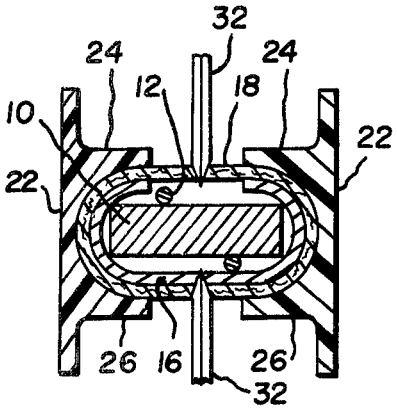
FIG. 2
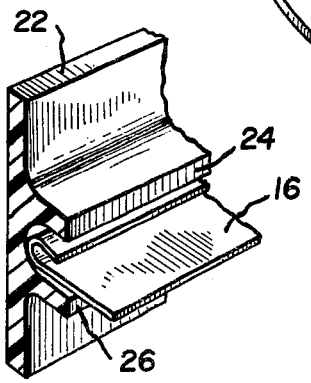
FIG. 4
FIG. 5
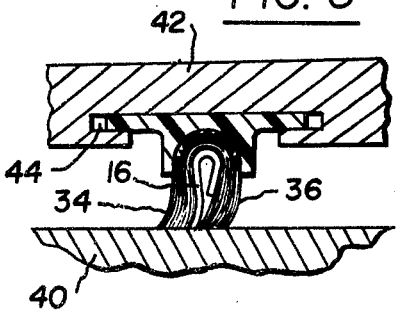
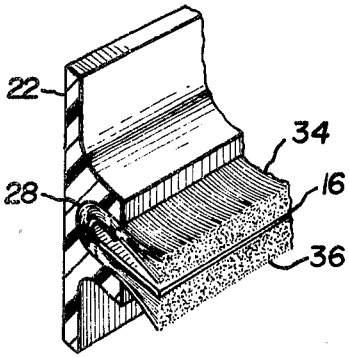
FIG. 3

AIR PERVIOUS WEATHERSTRIP

The present invention relates to weatherstrips and particularly to pile weatherstrips which are used with closure members such as window sash and doors.

The invention is especially suitable for use with prime windows or doors when used with storm windows or doors which also may be equipped with weatherstrip embodying the invention. The invention is also applicable for other weatherstripping purposes.

Weatherstripping has been designed to act as a barrier or seal against the elements and to prevent wind, rain and other elements from passing through an impervious barrier in the weatherstrip. Various approaches have been adopted to provide this barrier. One of these approaches is to use a fin of impervious material adjacent to one or more rows of pile (see U.S. Pat. Nos. 632,400 issued June 28, 1900; 1,804,799 issued May 12, 1931; 2,223,459 issued Dec. 3, 1940; 2,931,434 issued Apr. 5, 1960; 3,175,256 issued Mar. 30, 1965; 3,404,487 issued Oct. 8, 1968; 3,677,851 issued July 18, 1972; 3,745,053 issued July 10, 1973; and 3,935,043 issued Jan. 27, 1976. In each case the fin bears against the surface of one of the closure members to prevent the infiltration of air through the weatherstrip.

Another approach, again to prevent air infiltration through the weatherstrip is to make the pile of fibers having different diameter (denier). Specifically, rows of pile fibers of different density have been proposed (see U.S. Pat. No. 3,836,421 issued Sept. 17, 1974) or the fibers of different diameter have been interspersed in the same pile (see U.S. Pat. No. 3,944,693 issued Mar. 16, 1976). Increasing the diameter of the pile fibers has the effect of increasing the density of the pile which results in an increased stiffness. This has the adverse effect of interfering with the operation of the window or door. Specifically, the heavy density pile gives rise to higher compression forces. Great force then must be applied by the operator to break free and slide the window or door. Such increased break-free or sliding forces may be hazardous, particularly since children may not be able to open a window or door to obtain an exit in the event of an emergency.

It is a feature of this invention to provide an improved weatherstrip which in operation does not give rise to high break-free and sliding friction forces as may be experienced with high density pile weatherstripping.

While weatherstrip designs which have been previously proposed have sought after and obtained a barrier which is impervious to air, the invention, to the contrary, provides for controlled air infiltration through the weatherstrip. In so doing, hazards to health which arise from the lack of enough oxygen and the presence of unwanted gases in a sealed vehicle or room is avoided.

In permitting a controlled amount of air to pass through the weatherstrip, the problem of condensation on either the storm or the prime sash is greatly reduced. When an impervious weatherstrip is used on the prime sash and the storm sash is loose, as is often the case, the cold outside air flows into the space between the prime and storm sash causing condensation on the inside of the prime sash. When both sash are equipped with weatherstrip in accordance with the invention, a controlled amount of air enters the space between the sash allowing the temperature to drop to the point where condensation would not occur.

Accordingly, it is an object of the present invention to provide an improved weatherstrip.

It is further object of the invention to provide weatherstrip which provides a controlled amount of air infiltration through the weatherstrip when it is in sealing engagement between closure members.

It is a still further object of the present invention to provide improved weatherstrip which provides controlled air infiltration between relatively movable members which are sealed by the weatherstrip without adversely affecting the break-free and sliding friction forces necessary for the operation of the closure members.

Briefly described a weatherstrip provided by the invention is mountable on at least one of a pair of relatively movable closure members. The closure members may be a window sash or a door. This weatherstrip provides sealing engagement between the closure members with controlled air infiltration laterally through the weatherstrip and without increasing the forces needed to move the closure members (viz, to break free and open the sash or the door). The weatherstrip uses a backing strip which can be attached to one of the closure members. A membrane of air previous material extends longitudinally along the backing strip and is attached to the backing strip along a line running between the edges of the backing strip. This membrane may be a floppy material (viz, non-self-supporting). It may be a thin membrane of woven or non-woven material, suitably synthetic fabric. In a preferred form it is a non-woven fabric of polypropylene material. Two rows of pile fibers are attached to the backing strip and extend longitudinally along the strip. The fibers of the pile project outwardly from the backing strip and are compressed when the closure members are brought together with the weatherstrip in sealing engagement therebetween. The membrane is in juxtaposition with the rows. Each row is on an opposite side of the membrane and maintains the membrane in vertical position with the free end of the membrane upright. The membrane provides for limited passage of air through the weatherstrip. The density of the pile is insufficient to effect the necessary limitation upon the passage of the air through the weatherstrip and as such, the pile does not have a stiffness which could interfere with the movement of the closure members by requiring more than a desirable moving force.

The foregoing and other objects and advantages of the invention as well as a presently preferred embodiment thereof will become more apparent from a reading of the following description in connection with the accompanying drawings in which:

FIG. 1 is a perspective view schematically showing apparatus for fabricating weatherstrip which embodies the invention;

FIG. 2 is a sectional view through the portion of the apparatus shown in FIG. 1 where the slitter is located, showing the slitting operation of the apparatus;

FIG. 3 is a perspective view showing a segment of a completed weatherstrip embodying the invention;

FIG. 4 is a perspective view of the weatherstrip shown in FIG. 3 but with the pile fibers removed so as to illustrate the air previous membrane; and FIG. 5 is a fragmentary sectional view showing the weatherstrip embodying the invention installed in one of two relatively moveable closure members, specifically a window sash and a window, with the weatherstrip providing a sealing engagement between the closure members with controlled air filtration.

The construction of the weatherstrip embodying the invention may be more clearly understood from FIGS. 1 and 2 which illustrate how the weatherstrip is fabricated. The method of fabricating the weatherstrip is generally similar to the weatherstrip fabricating method described in United States Patent application, Ser. No. 354,893, filed by Robert C. Horton, the present applicant, on Apr. 26, 1973. The apparatus permits two weatherstrips to be fabricated simultaneously. The fabrication of one of these strips is shown in FIG. 1 to simplify the illustration. An endless band 10 is continuously driven in a direction from right to left as shown in the drawing. Stripper wires 12 are laid on the opposite sides of the band 10 offset from the center of the band as shown in FIG. 2. A forming head 14 is provided through which the band passes. An air previous membrane 16 which is in the form of a strip of material, preferably a non-woven fabric of thermoplastic material such as polypropylene, is fed into the forming head 14 and is wrapped by the forming head 14 around the back surface and the edges of the band. The width of the membrane strip 16 is less than twice the width of a side of the band so as to provide surface area around the edges of the band.

Next, fibers in the form of yarn 18, suitably of thermoplastic material such as polypropylene, is wound around the band over the membrane 16. One or more strands of the yarn 18 are wound around the band and membrane strip as they travel through the apparatus. Weaving heads 20 spin and wind the yarn. One such weaving head is shown. It will be appreciated that separate weaving heads are provided for each strand. The density of the pile which is provided in the weatherstrip is a function of the number of strands which are wound. The density used depends upon the application for the weatherstrip. For example, a denser pile is normally used in the case of heavy and large sliding doors than in the case of storm window sash. Infiltration is controlled by means of the membrane 16, and the permeability to air and water of the membrane in a direction laterally through the weatherstrip where it provides sealing engagement is less than the permeability of the pile, even in dense piles, such that the combination of the pile and the membrane provide the permeability which is desired (such as by being specified for the application).

Further along the travel of the band, backing strips are fed on to the edges of the band. Only one backing strip is shown in the rear edge of the band and it will be appreciated that a similar backing strip is fed on to the front edge of the band so that two weatherstrips can simultaneously be fabricated. The backing strip 22 suitably is a plastic extrusion of flexible thermoplastic material, such as polypropylene. The backing strip is formed with flanges 24 and 26. These flanges define a channel 28 into which the yarn wrapped band is received.

Next, ultrasonic heads 30 are provided which contact the back of the backing strips 22 and weld the membrane strip 16 and the yarn to the backing strip 22 at the channel 28. Two such ultrasonic welding heads 30 are provided which are offset from each other along the path of the band 10.

After welding, the band feeds the welded weatherstrips between slitter wheels 32 which slit through the yarn and, in the case of the slitter wheel which faces the bottom of the band, also through the membrane strip 16. As shown in FIG. 2 the stripper wires 12 lift the yarn 18 and the membrane strip 16 away from the band 10 so as to permit slitting without the slitter wheels having to contact the band which might dull the slitter wheels 32.

Each weatherstrip is produced continuously and is flexible. As the weatherstrip is slit, it may be wound on reels which may be supplied to the manufacturers of storm windows and doors for installation therein, or to other customers.

As shown in FIG. 3 the finished weatherstrip consists of the backing strip 22, two rows of pile 34 and 36 (made up of the yarn fibers 18), and the air infiltration membrane strip 16 which is located between the rows. The membrane strip 16 is not self-supporting. However, by virtue of its location between the rows 34 and 36 with the rows 34 and 36 on opposite sides of the membrane strip 16, the membrane strip 16 is supported vertically with respect to the backing strip 22 and in upright position. The free end of the membrane strip 16 is co-terminous with the ends of the pile 34 and 36, as will be apparent from the slitting operation (see FIG. 2). As shown in FIG. 4, the attached end of the membrane strip 16 is folded over somewhat. The height of the fold need not exceed the height of the flanges 24 and 26. The attachment of the membrane strip 16 is along a line running between the edges of the backing strip 22 and particularly along the center of the backing strip. The pile 34 and 36 and the membrane strip 16 extend beyond the flanges 24 and 26 and may extend various distances above the flanges 24 and 26 depending upon the application for the weatherstrip. Above the flanges 24 and 26 the pile bushes outward laterally (viz, towards the edges of the backing strip 22). The membrane 16 remains between the rows of pile 34 and 36 so as to be in a position to serve its air infiltration control purpose. The membrane strip is suitably of woven or non-woven fibrous material. It is desirably a fabric of synthetic material, such as polypropylene, nylon or the like.

In a preferred form of the weatherstrip the membrane strip is made of non-woven polypropylene material. Such material may be about five mils (0.005 inch) in thickness. Non-woven polypropylene is made from polypropylene yarn which is commutated and calendered or otherwise caused to form a fabric. The material is available under the tradename "Webril," from The Kendall Company, Fiber Products Division, Boston, Mass. 02101. The membrane 16 of such fabric is pervious to air and permits controlled air infiltration laterally through the weatherstrip (viz, through the membrane 16 and the pile rows 34 and 36). The membrane 16 can also be provided by woven material or by a suitably perforated sheet of impervious material such as plastic or rubber. The density of the perforations may be varied to control the amount of air filtration to satisfy a given application.

FIG. 5 illustrates the weatherstrip is use between a window 40 and a frame 42 which constitute closure members. Alternatively, the lower closure member 40 may be a threshold or door frame and the member 42 may be the edge of a door. The door or window may be aluminum of the type conventionally used for windows and doors. An undercut channel 44 in the upper member 42 receives the backing strip 22 of the weatherstrip. The pile 34 and 36 and the membrane strip 16 are compressed as the closure members 40 and 42 are brought together. By virtue of the low density of the pile 34 and 36 (the air infiltration control being provided by the membrane 16 and high density in the pile are not being required for infiltration control) the compression forces exerted by the pile 34 and 36 are minimal. The friction forces due to the weatherstrip are therefore low and the weatherstrip does not interfere with the breakfree or sliding of the closure members 40 and 42. In this manner compliance with specifications for breakfree and sliding forces, as are promulgated by the Architectural Aluminum Manufacturers Association (AAMA) is readily attained. Weatherstrip in accordance with the invention will also make possible compliance with specifications for air leakage rate through storm windows and doors, which are promulgated by the AAMA or other authorized bodies.

While a preferred embodiment of the invention has been described, variations and modifications within the scope of the invention will undoubtedly suggest themselves to those skilled in the art. Accordingly, the foregoing description should be taken merely as illustrative and not in any limiting sense.

What is claimed is:

1. A weatherstrip mountable on at least one of a pair of relatively movable closure members for providing sealing engagement thereof with controlled air infiltration laterally therethrough without increasing the forces needed to move said members, said weatherstrip comprising a backing strip which is fixed to one of said pair of closure members when said weatherstrip is mounted thereon, a membrane of air pervious material extending longitudinally along said backing strip and attached thereto along a line running between the edges of said backing strip, at least one edge of said membrane being free, two rows of pile fibers extending longitudinally along said backing strip and being attached thereto and projecting therefrom, said pile fibers projecting outwardly from said backing strip toward the other of said pair of closure members, said rows of pile fibers having a density such that air can pass through said rows when said closure members are in engagement and such that the stiffness of said pile is insufficient to interfere with the movement of said closure members by requiring movement forces of large magnitude, and said membrane being in juxtaposition with said rows on opposite sides of said membrane and being maintained in vertical position with said free end upright for providing limited passage of air laterally through said weatherstrip.

2. The invention as set forth in claim 1 wherein said membrane is a non-rigid strip.

3. The invention as set forth in claim 1 wherein said strip consists of fibrous material.

4. The invention as set forth in claim 3 wherein said strip consists of material selected from non-woven fabric and woven fabric.

5. The invention as set forth in claim 4 wherein said fabric material is a synthetic material.

6. The invention as set forth in claim 5 wherein said membrane is a strip of air pervious polypropylene fabric.

7. The invention as set forth in claim 6 wherein said strip is a non-woven polypropylene fabric about five (5) mils in thickness such that it is non rigid.

8. The invention as set forth in claim 5 wherein said pile consists of synthetic yarn.

9. The invention as set forth in claim 8 wherein said backing strip is a flexible strip of thermoplastic material, and ultrasonic welds attaching said pile and said membrane strip to said backing strip on one face thereof.

10. The invention as set forth in claim 9 wherein said membrane is of non rigid polypropylene material, said backing strip is of polypropylene, and said yarn is polypropylene.

11. The invention as set forth in claim 1 wherein the water and air permeability of said membrane in a direction laterally through said weatherstrip when disposed in sealing engagement with said closure members is less than the air and water permeability of said rows of pile.

* * * * *